US008978186B2

(12) United States Patent
Veening et al.

(10) Patent No.: US 8,978,186 B2
(45) Date of Patent: Mar. 17, 2015

(54) SELF-CONTAINED AND WIRELESS DEVICE FOR A WASHING MACHINE

(75) Inventors: Jan Eduard Veening, De Meern (NL); Lambertus Gerardus Petrus Van Der Heijden, Bunnik (NL); Robert-Jan Reinier Uhlhorn, Tricht (NL)

(73) Assignee: Diversey, Inc., Sturtevant, WI (US)

( * ) Notice: Subject to any disclaimer, the term of this patent is extended or adjusted under 35 U.S.C. 154(b) by 807 days.

(21) Appl. No.: 11/570,474

(22) PCT Filed: Mar. 22, 2006

(86) PCT No.: PCT/US2006/010329

§ 371 (c)(1),
(2), (4) Date: Jun. 27, 2007

(87) PCT Pub. No.: WO2006/102373

PCT Pub. Date: Sep. 28, 2006

(65) Prior Publication Data

US 2008/0110479 A1 May 15, 2008

(30) Foreign Application Priority Data

Mar. 24, 2005 (EP) ..... 05102413

(51) Int. Cl.

| | |
|---|---|
| ***D06F 35/00*** | (2006.01) |
| ***A47L 15/00*** | (2006.01) |
| ***A47L 15/44*** | (2006.01) |
| ***D06F 39/00*** | (2006.01) |

(52) U.S. Cl.

CPC ..... *A47L 15/006* (2013.01); *A47L 15/0049* (2013.01); *A47L 15/449* (2013.01); *A47L 2401/023* (2013.01); *A47L 2501/26* (2013.01); *D06F 39/004* (2013.01)

USPC ..... 8/158; 134/113; 68/12.18

(58) Field of Classification Search

USPC ..... 8/158, 159; 68/13 R, 17 R, 213, 235 R; 134/18, 113, 56 R; 222/23; 210/85

See application file for complete search history.

(56) References Cited

U.S. PATENT DOCUMENTS 1,876,210 A * 9/1932 De Vries ..... 74/42
2,968,172 A * 1/1961 Johnson ..... 68/17 R (Continued)

FOREIGN PATENT DOCUMENTS

CN 1455863 11/2003
EP 1088927 4/2001

(Continued)

OTHER PUBLICATIONS

International Search Report from the European Patent Office.

(Continued)

*Primary Examiner* — David Cormier
(74) *Attorney, Agent, or Firm* — Michael Best & Friedrich LLP

(57) ABSTRACT

The invention relates to a self-contained and wireless monitoring device (10) for use in a washing machine (1) to indicate shortage of detergent in said washing machine. The monitoring device comprises a sensor (13) arranged to monitor detergent concentration in washing liquid (5) of said washing machine and to provide an alarm signal (A) when said monitored detergent concentration is below a target value. The monitoring device is capable of floating in said washing liquid and comprises signalling means (11) for indicating said shortage of detergent in response to said alarm signal. The invention further relates to a package containing such a monitoring device and a method for indicating shortage of detergent.

19 Claims, 3 Drawing Sheets

(56) References Cited

U.S. PATENT DOCUMENTS

Figure 1:
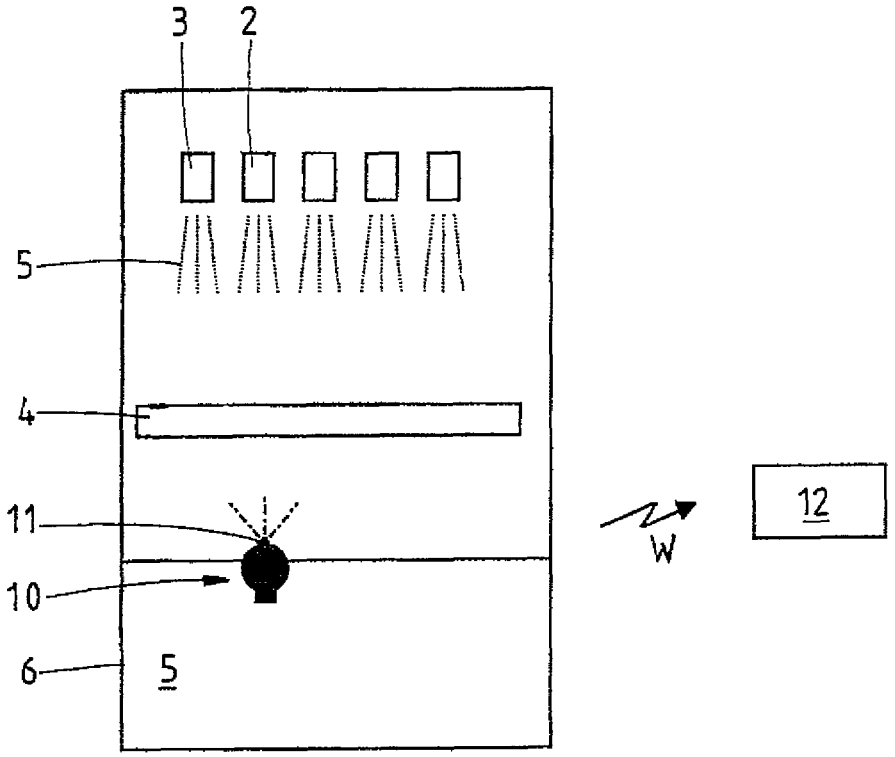

| | | | | |
|---|---|---|---|---|
| 4,756,321 | A * | 7/1988 | Livingston et al. | 134/56 D |
| 5,315,847 | A * | 5/1994 | Takeda et al. | 68/12.02 |
| 2003/0227394 | A1 * | 12/2003 | Rothgeb et al. | 340/870.01 |

FOREIGN PATENT DOCUMENTS

| | | | |
|---|---|---|---|
| JP | 58-153360 | | 10/1983 |
| JP | 60-147023 | | 9/1985 |
| JP | 08-189910 | | 7/1996 |
| JP | 9024016 | | 1/1997 |
| WO | 97/09480 | | 3/1997 |
| WO | WO 0107702 | A1 * | 2/2001 |
| WO | 02/29150 | | 4/2002 |
| WO | 03/100153 | | 12/2003 |

OTHER PUBLICATIONS

Japanese Notification of Rejection—Dispatch Date: Mar. 2, 2011.

* cited by examiner

SELF-CONTAINED AND WIRELESS DEVICE FOR A WASHING MACHINE

The invention relates to a monitoring device for use in a washing machine and a method to indicate shortage of detergent in said washing machine.

Advanced industrial dishwashers are nowadays equipped with automatic dosing systems to monitor the available detergent for the washing process and to refill detergent if required. These automatic dosing systems employ conductivity sensors to monitor the detergent concentration in washing liquid of said dishwashing machine. Such a system is disclosed in JP9-024016.

Another approach is disclosed in WO 01/07702, wherein a monitoring device for monitoring a washing process inside a washing apparatus comprises means for measuring physical and/or mechanical parameters of the washing process and means for recording the measured parameters. After the washing process is finished, the parameters are extracted from the monitoring device using an external device. The monitoring device can be positioned loosely inside the washing apparatus, e.g. on top of a conveyor belt of an industrial dish washer, and, as a result, may be used in a standard washing apparatus without the need of modifications.

It is an object of the present invention to provide a less complex and inexpensive monitoring device. Such a monitoring device is especially suitable for small dishwashing machines for which it is often not viable to install an automatic dosing system employing a conductivity sensor. Operators of these dishwashing machines who manually dose detergents often only estimate when to refill detergent, which is inefficient as this results in spillage or bad cleaning and may further result in calcification of machine components.

In an aspect of the invention, this object is accomplished by a self-contained and wireless monitoring device for use in a washing machine to indicate shortage of detergent in said washing machine, said monitoring device comprising a sensor arranged to monitor detergent concentration in washing liquid of said washing machine and to provide an alarm signal when said monitored detergent concentration is below a target value, wherein said monitoring device is capable of floating in said washing liquid and comprises signalling means for indicating said shortage of detergent in response to said alarm signal.

In another aspect of the invention, a method is disclosed for indicating shortage of detergent in a washing machine by a monitoring device capable of floating in washing liquid of said washing machine and comprising signalling means to indicate shortage of detergent for said washing machine, comprising the steps of:

- providing said monitoring device into said washing liquid of said washing machine, and
- inspecting said signalling means in a floating state of said monitoring device to determine whether refilling of detergent is required.

The self-contained and wireless monitoring device is easily provided in any type of washing machine, whereas the floating character of the monitoring device allows easy inspection of the signalling means to verify whether refill of detergent is required. It is noted that the self-contained nature of the monitoring device implies that the monitoring device has an internal energy source, such as a (rechargeable) battery, a biobattery using e.g. enzymes or a galvanic element wherein e.g. two different metals are exposed to the washing liquid to charge a capacitor for powering the monitoring device. It should be appreciated that, although the monitoring device is preferrably for use in (small) dishwashing machines, other washing machines including laundry washing machines or bottle washing machines may use the monitoring device of the invention.

Further aspects and embodiments of the invention are defined in the dependent claims and will be elucidated in the detailed specification.

The invention will be further illustrated with reference to the attached drawings, which schematically show preferred embodiments according to the invention. It will be understood that the invention is not in any way restricted to these specific and preferred embodiments.

Figure 2:
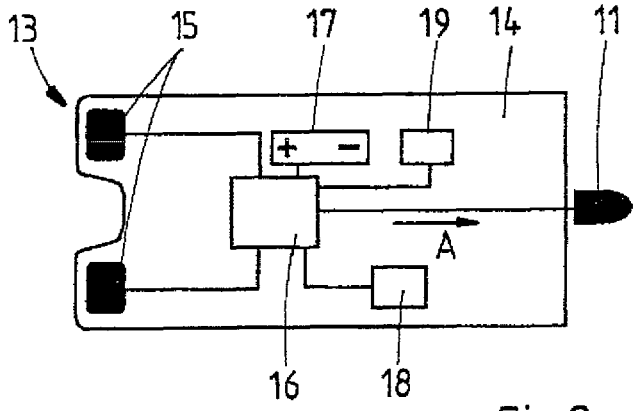
Figure 3C:
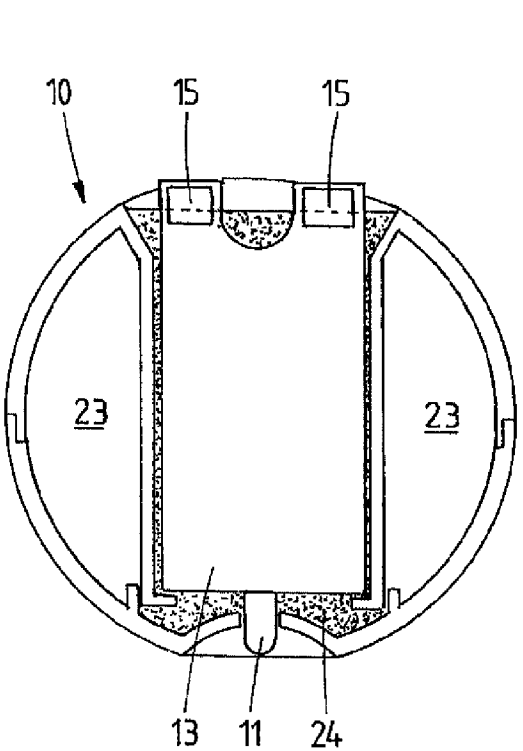
Figure 3B:
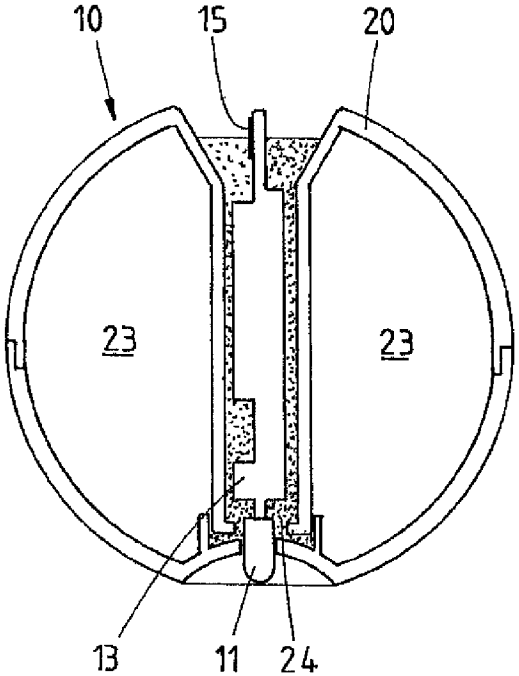
Figure 3A:
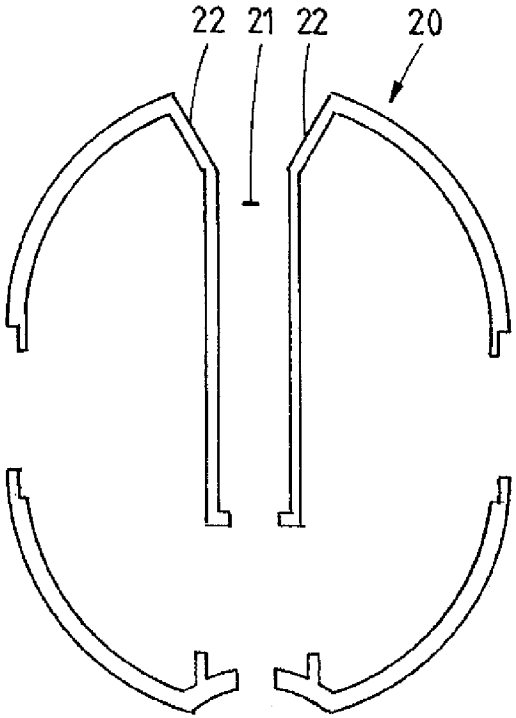
Figure 4B:
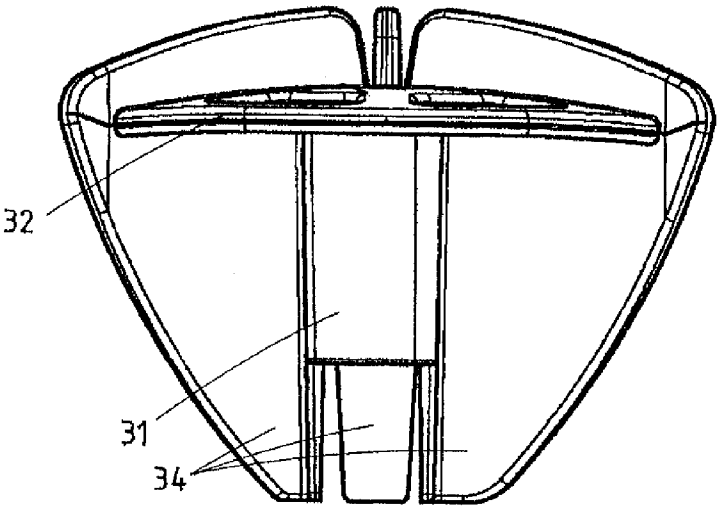
Figure 4C:
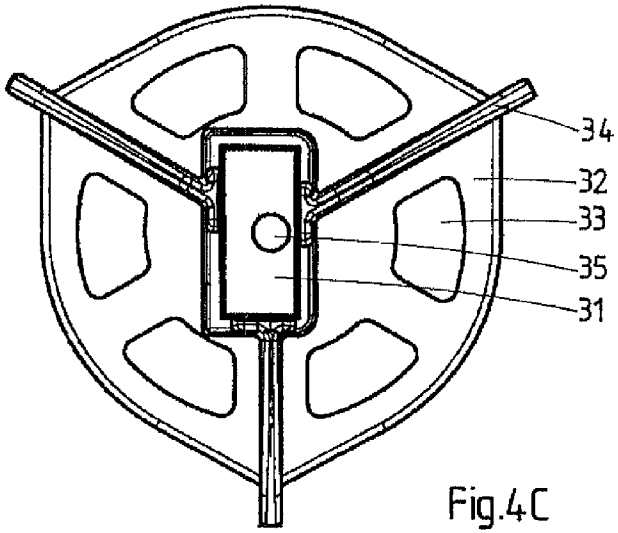
Figure 4A:
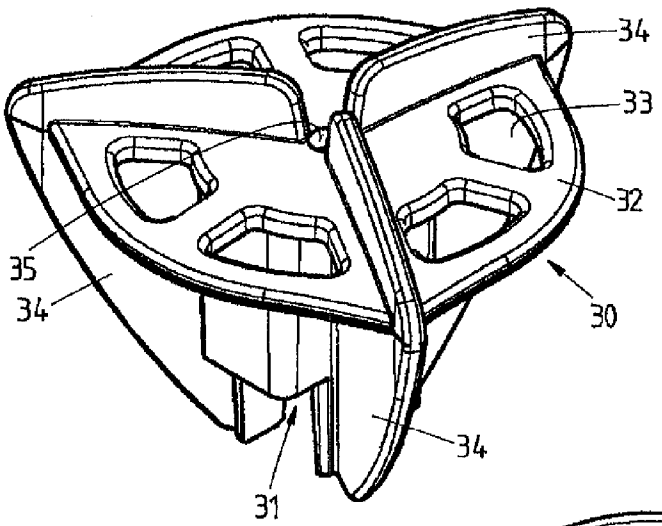

In the drawings:

FIG. 1 schematically illustrates a dishwashing machine provided with a monitoring device according to an embodiment of the invention;

FIG. 2 schematically illustrates a sensor according to an embodiment of the invention;

FIGS. 3A-3C show cross-sections of a monitoring device according to an embodiment of the invention, and FIGS. 4A-4C show representation for an alternative body for the sensor of FIG. 2.

FIG. 1 schematically shows a dish washing machine 1 comprising a plurality of nozzles 2, 3 to clean dishes 4 by washing liquid 5 containing detergent. The washing liquid 5 is present in a tub 6. The washing liquid 5 is circulated by a pump (not shown) from the tub 6 to nozzles 3 and subsequently over the dishes 4. Clean rinsing water can be provided from the nozzles 2. The dishes 4 are typically rinsed after each washing cycle with clean water which dilutes the washing liquid 5.

A monitoring device 10 according to an embodiment of the invention is capable of floating in the washing liquid 5. It is noted that washing liquid 5 typically remains within the tub 6 after completion of a washing cycle for several cycles. The monitoring device 10 comprises signalling means 11 to indicate shortage of detergent in the washing liquid 5 for the dishwashing machine 1. Accordingly, the monitoring device 10 can be provided into the tub 6 before a washing cycle, simply by disposing it in the washing liquid 5. After completion of the washing cycle, the signalling means 11 can be inspected, facilitated by the floating nature of the monitoring device 10, to verify whether the washing liquid 5 still contains sufficient detergent. The monitoring device 10 is balanced to have said signalling means 11 in a substantially upright position in a floating state.

Preferably, the signalling means 11 comprises a lamp, e.g. a high power light emitting diode (LED). The light of the LED 11 may flash in order to allow easy inspection. Still further, the light of the LED 11 may change colour in case of shortage of detergent. For example, the LED 11 may provide a green flashing light if sufficient detergent is detected, whereas a red flashing light is emitted in case of shortage of detergent. In another example, no light is emitted when sufficient detergent is detected, whereas a red flashing light is emitted when is detergent deficit is detected. Alternatively or in addition, the signalling means 11 may provide audible signals, such as beeps. The frequency and/or loudness level of said beeps may vary.

In a more advanced embodiment, the signalling means 11 may wirelessly transmit a signal to a distant receiver 12, indicated by the arrow W. The distant receiver may be integrated within the dishwashing machine 1 or be a separate unit as shown in FIG. 1. Alternatively, the distant receiver 12 may receive data via a unit (not shown) in the dishwashing machine 1 that communicates with the monitoring device 10. In that case, the dishwashing machine 1 should be capable of performing such a function.

In order to monitor the detergent concentration in the washing liquid 5 to indicate the shortage of detergent, the monitoring device 10 employs a sensor 13 as shown in FIG. 2. The sensor 13 comprises a plurality of components and tracks provided on a circuit board 14, including electrodes 15, processing circuitry 16, an internal battery 17 and, optionally, data storage means 18 and a temperature sensor 19. Although hereinafter an electrical sensor will be described, the sensor may, in an embodiment of the invention, pertain to e.g. a chemical sensor for monitoring the detergent concentration in the washing liquid 5.

The use of the circuit board 14 enables the sensor 13 to be executed as a micro device, i.e. a dedicated micro conductivity sensor. The dimensions of the circuit board 14 may preferably be in the range between 10 and 50 mm in both directions, such as 20×20 mm.

The electrodes 15 are arranged such that these may be exposed to the washing liquid 5 in order to monitor the detergent concentration. The electrodes 15 are provided on different positions on the circuit board 14 separated by a cut-out of said board 14. The electrodes 15 may be flat plates accommodated in etched recess of the circuit board 14. However, it should be appreciated that the electrodes 15 may have an alternative shape, including e.g. rods. To avoid monitoring inaccuracies by corrosion of the submerged electrodes 15, these are provided with a coating comprising e.g. carbon, gold, tin or an alloy thereof.

The processing circuitry 16 may include various electrical components, such a resistors, capacitors and one or more integrated circuits suitably connected via wires or printed circuit tracks on said circuit board 14. In the pre-sent embodiment, the function of these components is to measure the conductivity of the washing liquid 5 in order to determine the detergent concentration. It should be appreciated that these functions can be implemented on the circuit board 14 in various manners known per se. WO 02/086481 provides an example of how the measurement of the conductivity of the washing liquid 5 may be performed.

It is further noted that the conductivity of the washing liquid 5 may depend on the temperature of the washing liquid 5. In order to avoid monitoring inaccuracies, the processing circuitry 16 preferably corrects for temperature effects, e.g. by determining the temperature of the washing liquid 5. The temperature of the washing liquid can be measured by a temperature sensor 19. The temperature sensor 19 may be fully accommodated within the body of the monitoring device 10. If a quick measurement is required, the temperature sensor 19 preferably has measuring portions (not shown) directly exposed to the washing liquid 5.

As the monitoring device 10 is a self-contained device, the sensor 13 has an internal energy source 17 in order to perform the monitoring function. A (rechargeable) battery may be used as well as a biobattery using e.g. enzymes or a galvanic element wherein e.g. two different metals are exposed to the washing liquid 5 to charge a capacitor for powering the monitoring device 10. Consequently, the monitoring device 10 can be applied without the need to modify the dishwashing machine 1.

The monitoring device 10 may comprise data storage means 18. These data storage means may e.g. comprise a lookup table with correction values to correct for temperature effects on the conductivity vs. detergent concentration relationship. Further, the measured conductivity values and other data may be stored to enable subsequent analysis by reading stored data. The type of detergent used in the washing liquid 5 may also determine operation of the monitoring device 10. The data storage means 18 allow programming of the monitoring device 10 for its intended purpose.

In operation, the electrodes 15 of the sensor 13 are submerged in the washing liquid 5. The temperature sensor 19 measures the temperature of the washing liquid 5 and provides this information to the processing circuitry 16. The processing circuitry 16 measures or derives the conductivity [and temperature] of the washing liquid 5 in a manner known per se in order to establish the detergent concentration. The established detergent concentration is compared with a target value preferably employing a correction value related to the measured temperature. This target value relates to the typically sufficient detergent concentration in the washing liquid 5. A safety margin may be applied. In case the detergent concentration is below the target value, the processing circuitry 16 triggers an alarm signal A for the LED 11. The LED 11 may flash in a particular colour as described above. Alternatively or in addition, the monitoring results may be stored in the storage means 18.

The monitoring device 10 is further arranged to switch off when no washing liquid 5 is present between the electrodes 15, i.e. the conductivity is low and the sensor 13 is in a sleeping mode. The alarm signal A is interrupted. Consequently, signalling by the signalling means 11 is avoided and the internal battery 17 is saved. As mentioned above, interruption of the alarm signal may also be performed when the monitored conductivity indicates the presence of sufficient detergent, such that no signals are emitted from the signalling means 11 in this case.

It is clear that the environmental conditions within the dishwashing machine 1 are harsh and the sensor 13 is to be protected against this environment. The monitoring device 10 may be waterproof, robust and chemically resistant against the detergent and other washing aids to allow the sensor 13 to function properly for a reasonable period of time.

In one embodiment, the sensor 13 may be partly embedded in a body of a material with a specific weight or gravity allowing the monitoring device 10 to float in the washing liquid 5. Such a material may e.g. be a resin. The electrodes 15 and LED 11 protrude through the resin body to respectively allow conductivity measurements and inspection. The body should preferably be chemically resistant in an environment with pH>12.

FIGS. 3A-3C display an embodiment of a monitoring device 10 accommodated within a body 20.

As can be observed from FIG. 3A, the body 20 comprises shaped portions to form a receiving space 21 for the sensor 13. Sidewalls 22 of the receiving space 21 widen on the side for the electrodes 15 of the sensor 13 to provide a larger volume at this location. The circuit board 14 is inserted in the receiving space 21 and the portions of the body 20 are welded to constitute air chambers 23, making the monitoring device 10 capable of floating. The welds are preferably able to be substantially leakproof in a temperature range between 15-90° C. The receiving space 21 is filled with a filler material 24 to embed the sensor 13 partially, leaving the LED 11 and electrodes 15 free. The vulnerable parts of the sensor 13 are consequently protected from the harsh conditions within the dishwashing machine 1.

The filler material 24 preferably is a resin. The resin 24 protects the vulnerable portions of the sensor 13 while it may simultaneously glue the portions of the body 20 to each other to form the monitoring device 10. The density of the resin is preferably low, such as 0.7 g/ml, to facilitate floating of the monitoring device 10. The resin 24 may e.g. comprise polyurethane, epoxy resin or silicone.

The widening sidewalls 22 ensure that the largest amount of filler material 24 is located near the electrodes 15. Consequently, the centre of gravity is located near this position, such that the floating monitoring device 10 is always in an upright position, i.e. the LED 11 is above the surface of the washing liquid 5 (see FIG. 1).

The body 20 is preferably made of plastic, such as polyethylene or polypropylene. The body 20 may have a spherical shape. The diameter of the body 20 may be in the range of 20-120 mm, preferably in the range of 40-90 mm, such as 60 mm. Preferably, the dimensions of the body 20 should be such that the monitoring device 10 is not washed with the washing liquid through the drain of the dish washing machine 1.

FIGS. 4A-4C show representations for an advantageous and preferred body 30 for the sensor of FIG. 2. It is noted that the sensor 13 is not shown in FIGS. 4A-4C. FIG. 4A shows a three-dimensional representation of the body 30, whereas FIGS. 4B and 4C show a side view and a bottom view respectively.

The body 30 comprises a receiving space 31 covered by a plate 32 with openings 33. Further, the body 30 has wings 34 that are positioned at angles of 120° in the present embodiment. The plate further has an opening 35 located in the centre. The body 30 has a full height in the ranges of 50-60 mm, e.g. 56 mm, whereas the outer points of the wings 34 define a virtual circle with a diameter in the range of 80-100 mm, e.g. 85 mm.

The sensor 13 can be introduced from the bottom side of the body 30 into the receiving space 31. The inner surface of the plate 32 may function as a stop while inserting the signalling means 11, such as the LED, through the opening 35. The dimensions of the circuit board 14 may be such that in this position, the electrodes 15 protrude from the receiving space 31, such that they may be fully exposed to the washing liquid 5. In order to isolate the rest of the sensor 13 from the washing liquid, the receiving space is filled with a filler material (not shown) such as the resin mentioned previously.

The body 30 in combination with the filler material in the receiving space 31 is dimensioned such that the LED 11 is in a substantially upright position in a floating state allowing easy inspection.

The openings 33 reduce fluid dragging of the monitoring device 10 by turbulent water during operation of the washing machine 1. The wings 34 prevent the body 30 to block the drain or pump inlet of the washing machine 1 by their shape and/or dimensions. The openings 33 assist in passing of water when the body 30 is in front of a drain or pump inlet. Finally, the wings 34 have a curvature, such that in a non-floating state, the body 30 rests on the wings 34 with the electrodes 15 lifted from the bottom of the washing machine 1. Accordingly, some remaining washing liquid 5, e.g. in dents of the bottom, would not force the monitoring device 10 to continue functioning.

The monitoring device 10 is a simple, small and low cost device enabling said device to be included in a detergent package.

The invention claimed is:

1. A self-contained and wireless monitoring device for use in a washing machine to indicate shortage of detergent in said washing machine, said monitoring device comprising:

a sensor arranged to monitor detergent concentration in washing liquid of said washing machine by floating in the washing liquid and to provide a signal indicative of a monitored detergent concentration;

a processor configured to receive the monitored detergent concentration signal, to compare it with a detergent concentration target value, and to provide an alarm signal when the monitored detergent concentration is below the target value; and at least one of a group consisting of a lamp and a sound-emitting device configured to receive the alarm signal and to communicate to a user that the monitored detergent concentration is below the target value in response to said alarm signal.

2. The monitoring device according to claim 1, wherein said sensor comprises electrodes exposable to said washing liquid, to monitor said detergent concentration on the basis of the conductivity of said washing liquid and, optionally, comprises means to measure the temperature of said washing liquid.

3. The monitoring device according to claim 1, wherein said sensor is provided on a circuit board comprising electrical components for monitoring said detergent concentration.

4. The monitoring device according to claim 1, wherein the at least one of the group consisting of the lamp and the sound-emitting device comprises signaling means, and wherein said monitoring device is balanced to have the signaling means in a substantially upright position in a floating state.

5. The monitoring device according to claim 1, wherein said monitoring device comprises a body capable of floating and embedding at least a portion of said sensor.

6. The monitoring device according to claim 5, wherein said body comprises a receiving space for accommodating said sensor and wherein said receiving space is filled with a filler material embedding at least a portion of said sensor.

7. The monitoring device according to claim 6, wherein said filler material is a resin.

8. The monitoring device according to claim 1, wherein said lamp comprises a light emitting diode.

9. The monitoring device according to claim 1, wherein the at least one of the group consisting of the lamp and the sound-emitting device comprises signaling means, and wherein said sensor is arranged to interrupt functioning of the signaling means in the absence of washing liquid.

10. The monitoring device according to claim 1, wherein said monitoring device is shaped to avoid said monitoring device to be washed through a drain of said washing machine and/or to block a pump inlet.

11. The monitoring device according to claim 10, wherein said monitoring device comprises a body with one or more wings.

12. A package comprising a detergent and a monitoring device according to claim 1.

13. A method for indicating shortage of detergent in a washing machine by a monitoring device capable of floating in washing liquid of said washing machine and comprising a sensor, a processor, and at least one of a group consisting of a lamp and a sound-emitting device to indicate shortage of detergent for said washing machine, comprising the steps of:

floating the monitoring device in said washing liquid of said washing machine;

monitoring detergent concentration in the washing liquid with the sensor;

providing a signal indicative of the monitored detergent concentration;

comparing the monitored detergent concentration signal with a detergent concentration target value;

providing an alarm signal when the monitored detergent concentration is below the target value;

receiving the alarm signal by the at least one of the lamp and the sound-emitting device; and communicating to a user with the at least one of the lamp and the sound-emitting device that refilling of detergent is required based on the provided alarm signal.

14. The method according to claim 13, wherein the at least one of the group consisting of the lamp and the sound-emitting device comprises signaling means, and wherein the signaling means are inspected after a washing cycle.

15. A wireless monitoring device for use in a washing machine to indicate shortage of detergent in the washing machine, the monitoring device comprising:

a body member capable of floating in washing liquid, the body member including a plurality of panel members defined by plate-shaped wings extending in a first direction and a second direction different from the first direction, the body member further including a plate member extending in a third direction different from at least one of the first and second directions and joining the panel members, the panel members and the plate member shaped to permit passage of washing liquid flow past the body member in a drain of the washing machine; and a sensor connected to the body member arranged to monitor detergent concentration in the washing liquid in the washing machine and provide a signal.

16. The monitoring device according to claim 15, wherein the plate member includes openings.

17. The monitoring device according to claim 15, wherein the panel members are defined by three panel members, one of the panel members extending from the plate member a shorter distance than the other two.

18. The monitoring device according to claim 17, wherein the panel members are sloped in an inward manner with respect to a central axis of the body member.

19. The monitoring device according to claim 15, wherein the plate member is constructed and arranged to provide a stop surface for the sensor.

* * * * *